US005428337A

United States Patent [19]

Vinclarelli et al.

[11] Patent Number: 5,428,337

[45] Date of Patent: Jun. 27, 1995

[54] CONDUCTIVE WINDING

[75] Inventors: Patrizio Vinclarelli, Boston; Jay M. Prager, Tyngsboro; Fred M. Finnemore, North Reading, all of Mass.

[73] Assignee: VLT Corporation, San Antonio, Tex.

[21] Appl. No.: 839,431

[22] Filed: Feb. 21, 1992

[51] Int. Cl.[6] ..... H01F 27/30

[52] U.S. Cl. ..... 336/223; 336/83

[58] Field of Search ..... 336/83, 223

[56] References Cited

U.S. PATENT DOCUMENTS

| | | | |
|---|---|---|---|
| 1,738,528 | 12/1929 | Dunlop | 336/223 X |
| 4,117,436 | 9/1978 | MacLennan | 336/83 X |
| 4,814,735 | 3/1989 | Williamson | 336/223 X |

FOREIGN PATENT DOCUMENTS

| | | | |
|---|---|---|---|
| 622710 | 3/1963 | Belgium | 336/270 |
| 2240687 | 2/1974 | Germany | 336/213 |
| 57206 | 3/1987 | Japan | 336/213 |

*Primary Examiner*—Leo P. Picard
*Assistant Examiner*—L. Thomas
*Attorney, Agent, or Firm*—Fish & Richardson

[57] ABSTRACT

A generally helical cut is made in a tubular conductive piece to form a winding, the winding having spaces between successive turns. The winding is axially compressed to reduce the spaces. One or more of the windings may be combined with one or more pieces of permeable or non-permeable material to form electromagnetic structures (for example, inductors or transformers) which have very high fill factors. A succession of such devices, each having possibly different numbers of turns on their windings, may be easily manufactured on a "lot-of-one" basis in an automated manufacturing environment.

14 Claims, 8 Drawing Sheets

CONDUCTIVE WINDING

BACKGROUND OF THE INVENTION

This invention relates to conductive windings.

Conductive windings are used, for example, in transformers and inductors. FIG. 1, for example, shows an inductor formed of wire 14 wound about a core 10. The core may be a permeable magnetic core (e.g., ferrite) or may be a simple permeable or non-permeable rod or air core. In general, a certain volume in the vicinity of the core of a magnetic component is available for a winding, or windings. In the inductor of FIG. 1, the length 16 of the winding (called the traverse) is fixed by the dimensions of the core, whereas the height 18 of the winding (called the build) might be limited by either the core dimensions or by other constraints imposed in the final application. Maximum efficiency of the inductor is achieved when the turns on the winding fill the entire volume defined by the allowable traverse and build. It can be shown that the highest possible proportion of the total allowable winding volume which can be occupied by conventional round wire (called the fill factor) is $\pi/4$ or about 75%. Additionally, for a given diameter of wire, even that fill factor can be achieved only for certain numbers of turns (e.g., when the build of the winding is an integer multiple of the diameter of the wire). By using rectangular cross-section wire, the unoccupied spaces between adjacent wires (which exist in the case of round wires) are largely eliminated and higher fill factors can be reached. However, for both round and rectangular cross-section wire, certain combinations of wire diameter and turns will require complicated arrangements of overlapping turns, or a multitude of parallel windings, to achieve high fill factors.

SUMMARY OF THE INVENTION

The invention enables simple construction of windings of any desired number of turns, within a broad range, and any desired fill factor, including fill factors approaching 100%.

Thus, in general, the invention features a method of forming a conductive winding. A generally helical cut is made in a tubular conductive piece to form the winding, the winding having spaces between successive turns. The winding is axially compressed to reduce the spaces.

Embodiments of the invention include the following features. The method is adapted for forming an electromagnetic structure by assembling the conductive winding with a permeable core. The cutting is done by applying a milling tool to the tubular piece. The tubular piece is rotated relative to the milling tool, and is simultaneously moved axially relative to the milling tool. The tubular piece is rotated with a constant angular velocity and moved with a constant axial velocity.

The winding may be annealed after being compressed. In the compressing and assembling, one core piece may be inserted into one end of the winding and a second core piece into another end of the winding. The winding is compressed until the core pieces are in a predetermined spatial relationship to each other (e.g., in direct contact or with a gap). Nonpermeable spacers may be inserted between the core pieces. The tubular piece may be of round cross-section.

Terminations may be formed on the winding by making non-helical cuts in the tubular helical piece at the beginning and ending of the helical cut. An insulating surface may be provided on the winding after the cutting.

In general, in another aspect, the invention features a method of making a succession of electromagnetic structures each having a core and a conductive winding. A succession of conductive windings is formed automatically, successive windings having possibly different numbers of turns. Each winding is formed by cutting a tubular conductive piece. Each of the conductive windings is assembled with a core.

Embodiments of the invention may include the following features.

For each conductive winding, a predetermined length of conductive material is cut from a continuous length of material, the length being determined based on the number of turns which the winding is to have. The tubular conductive piece is helically cut, and the pitch of the helical cutting is adjusted for each conductive winding based on the number of turns which the winding is to have.

At least some of the conductive windings are axially compressed to form the electromagnetic structures. The permeable cores for the electromagnetic structures may have the same configuration. There are spaces between the successive turns of the windings prior to compressing.

The cutting is done by applying a milling tool to the tubular piece. During cutting, the tubular piece is rotated relative to the milling tool, and simultaneously the tubular piece is moved axially relative to the milling tool. The winding may be annealed after compressing.

During the compressing and assembling one core piece is inserted into one end of the winding and a second core piece is inserted into another end of the winding; the winding is compressed until the core pieces touch.

The terminations may be formed by making non-helical cuts in the tubular helical piece at the beginning and ending of the helical cut. An insulating surface may be provided on the winding after the cutting.

In general, in another aspect, the invention features a conductive winding structure which includes a resilient helical winding having turns with cut edges, the winding being held in a compressed state.

In general, in another aspect, the invention features an electromagnetic structure which includes a resilient helical winding having turns with cut edges, and a core with which the winding cooperates electromagnetically, the winding being held about the core in a compressed state.

Embodiments of the invention may include the following features.

The core defines a space within which the winding is housed, a portion of the winding occupying substantially the entire volume within the space. There is essentially no space between the turns of the winding in its compressed state. The core comprises a pair of identical core pieces which are in contact when the winding is in the compressed state.

The windings are easy to fabricate. Any desired number of windings within a wide range can be made. On the fabrication line, it is simple to make lot-of-one windings each having a selected number of turns. The resulting electromagnetic structures are highly efficient and have high fill factors.

Other advantages and features will become apparent from the following description and from the claims.

DESCRIPTION

We first briefly describe the drawings.

Figure 2:
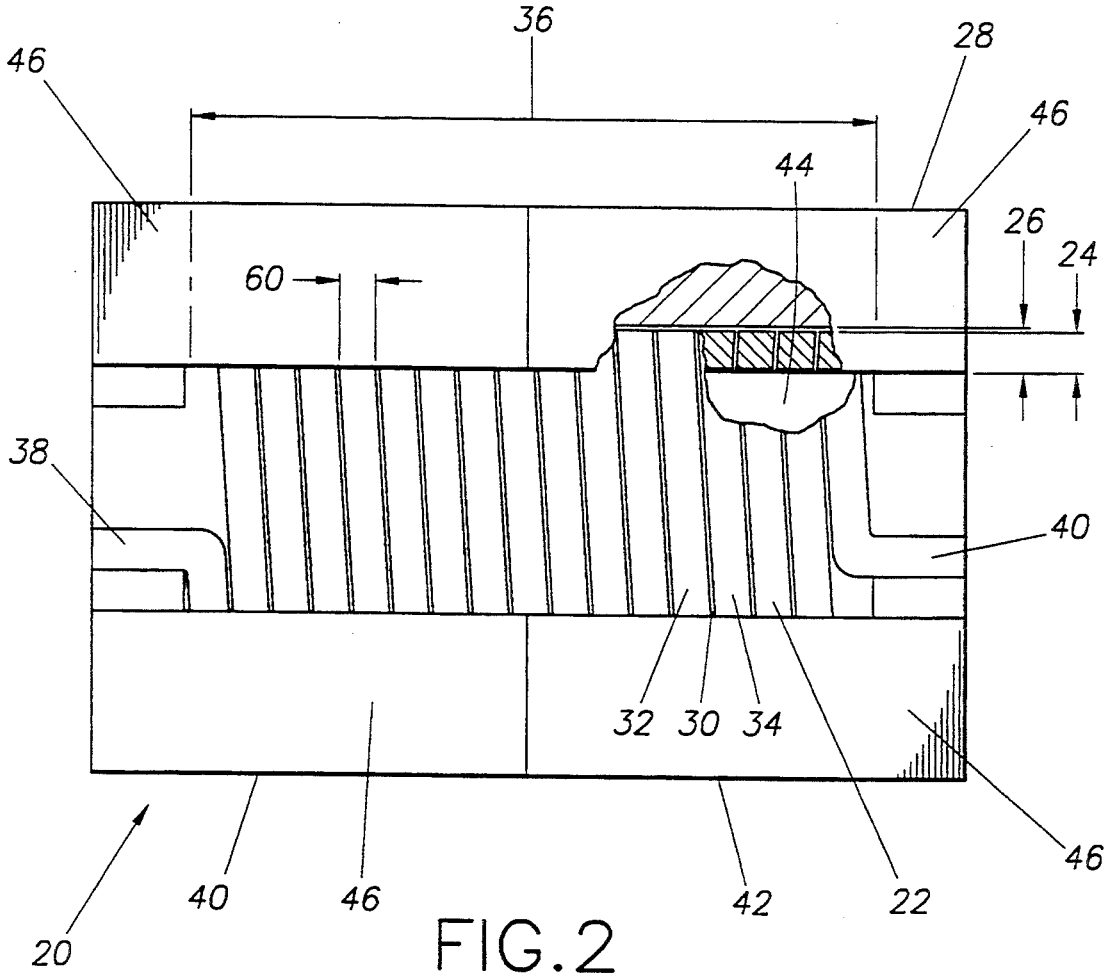
FIG. 2 is a top view, broken away, of an inductor according to the invention.

Referring to FIG. 2, an inductor 20 achieves a nearly 100% fill factor by including a winding 22 which is fabricated from a solid tube of conductive material (e.g., copper or aluminum). The thickness 24 of the solid tube is nearly as great as the build 26 defined within the permeable core 28. The gaps 30 between successive turns 32, 34 of the winding are nearly eliminated so that virtually the entire traverse 36 of the inductor is filled with conductive material. A termination 38, 40 is formed integrally at each end of the helical winding. The core 28 comprises two identical core pieces 40, 42. Each core piece has an inner cylindrical portion 44 which slips inside the winding and a pair of outer sleeve portions 46.

Figure 3:
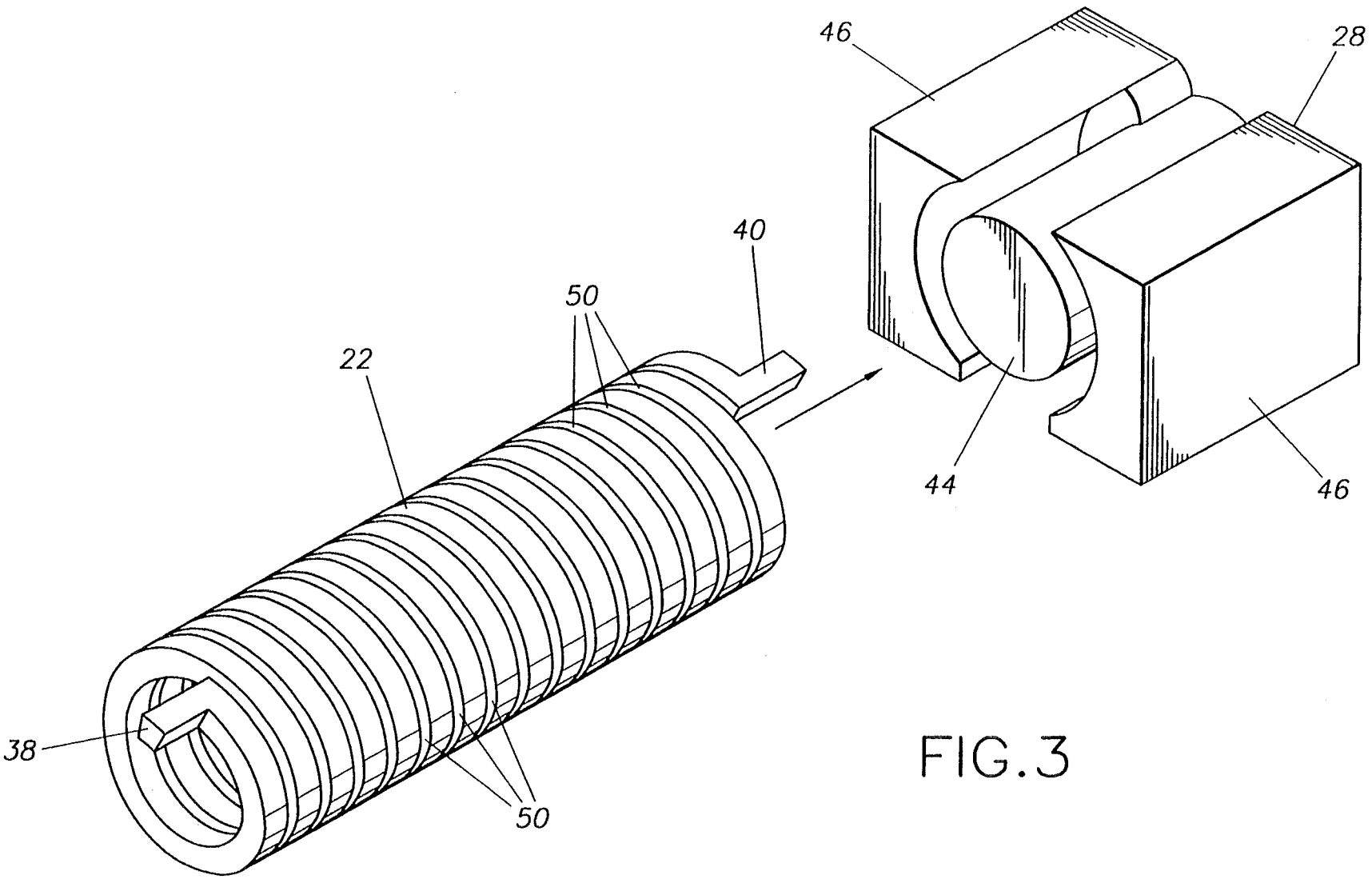
FIG. 3 is an exploded isometric view of a core piece and a winding.

Referring to FIG. 3, prior to assembly the winding 22 is in an expanded state with gaps 50 between successive turns of the winding. During assembly, the cylindrical portion 44 of one core piece is inserted into one end of winding 22. The cylindrical portion of the other core piece (not shown in FIG. 3) is inserted into the other end of the winding. The two core pieces are then pulled together until the free faces of their cylindrical portions touch, compressing the winding and seating it in the space defined by the two core pieces. The assembly is then mounted or housed in a way that maintains the compression. Alternatively, the winding may be compressed and annealed prior to mounting on the core pieces so that the tensile forces are removed from the winding prior to final assembly of the inductor.

By varying the width 60 (FIG. 2) of each turn, inductors having any desired numbers of turns within some range may be produced using the same core pieces, with the resulting inductors all having the same overall dimensions and configuration.

Figure 1:
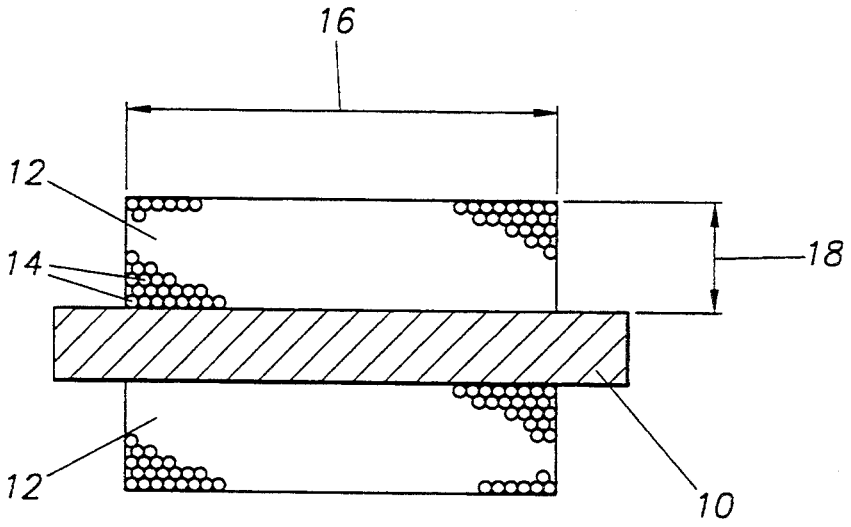
FIG. 1 is a sectional schematic view of an inductor.
Figure 5:
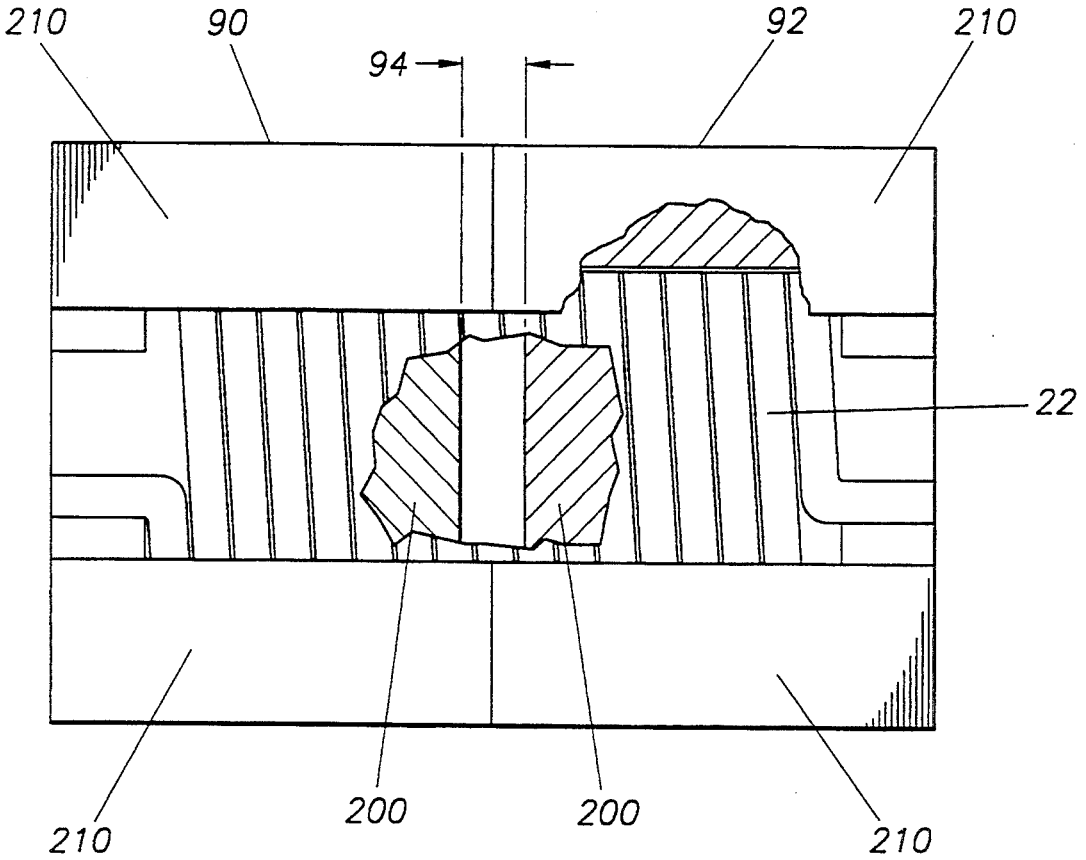
FIG. 5 is a top view, broken away, of an inductor having a gapped core structure.
Figure 6:
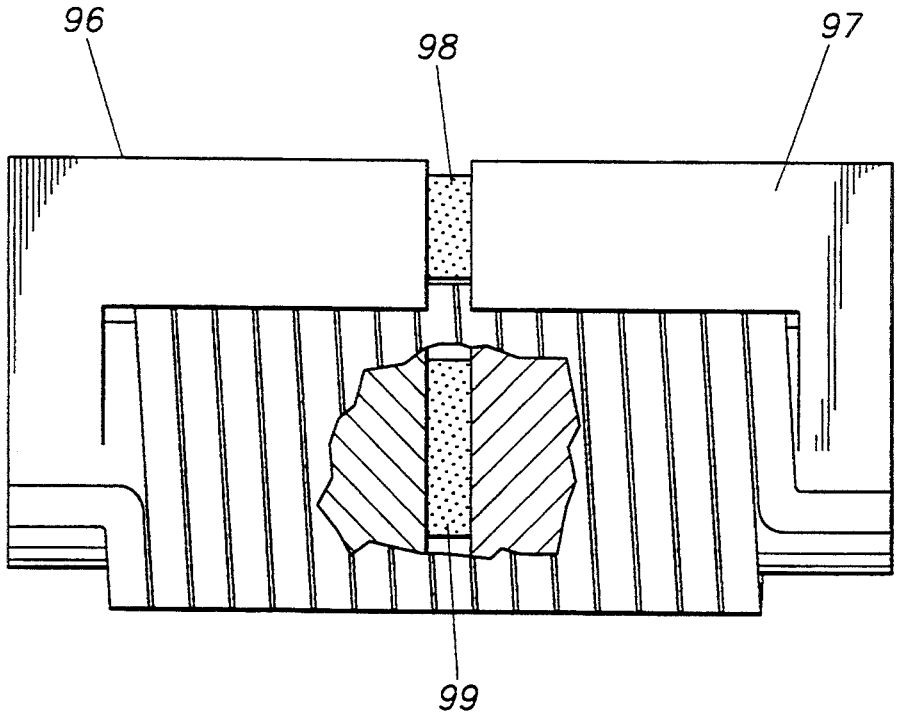
FIG. 6 is a top view, broken away, of another inductor with a gapped core structure.

A wide variety of inductors and transformers may be made. For example, referring to FIG. 4, in another inductor, just prior to assembly, each of the core pieces 80, 82 has a single outer sleeve 81 instead of two outer sleeves 46 (FIG. 2). In FIGS. 5 and 6, the inductors include gaps in the magnetic paths. In FIG. 5, core pieces 90, 92 are similar to those shown in FIGS. 1 and 2, except that the center portions 200 of the core pieces are shorter than the outer sleeves 210. When the faces of the outer sleeves of the core pieces meet during assembly, an air gap 94 is formed between the faces of the center portions.

Figure 4:
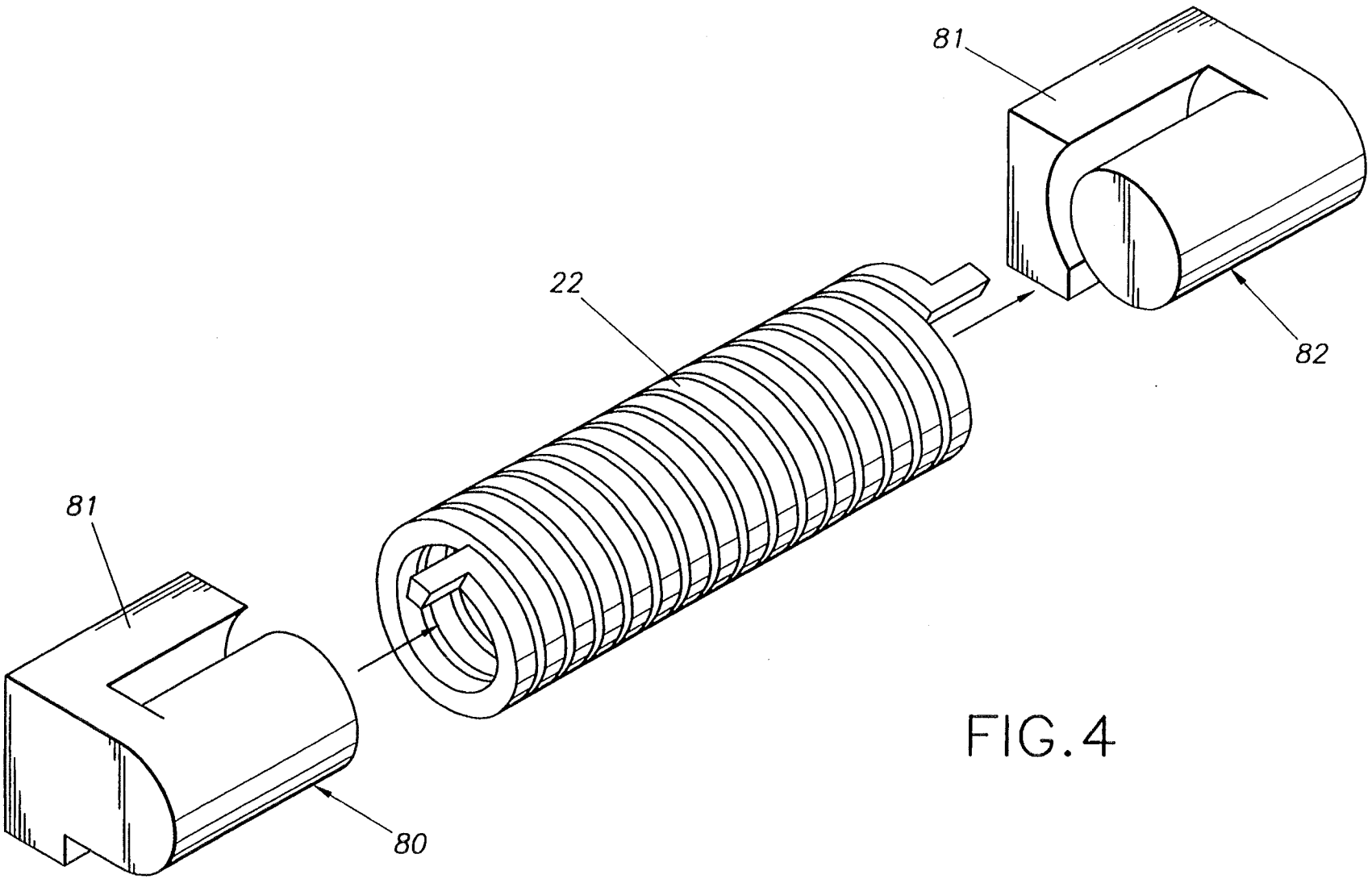
FIG. 4 is an exploded isometric view of pair of core pieces and a winding.

Alternatively, in FIG. 6, a pair of core pieces 96, 97, similar to the core pieces 80, 82 shown in FIG. 4, are separated by a pair of non-permeable spacers 98, 99.

Figure 7:
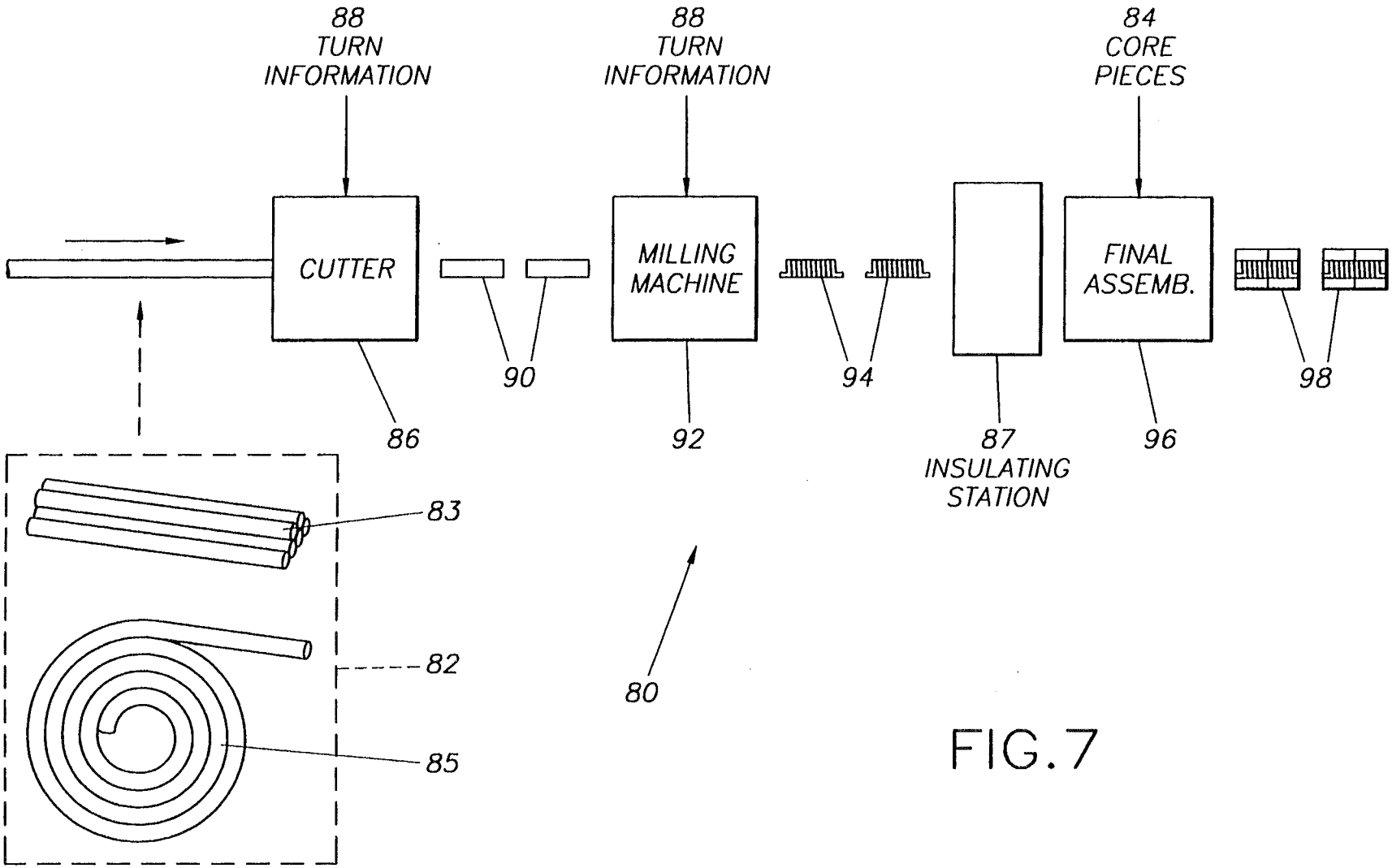
FIG. 7 is a schematic diagram of a production line.

Referring to FIG. 7, in a lot-of-one manufacturing line 80, successive inductors can be made automatically, each with a desired number of turns. A supply 82 of tubing (which, as shown schematically in the Figure, might be an inventory of relatively long sections of straight tubing 83 or a continuous reel of tube 85) of a diameter and wall thickness that corresponds to the configuration of the core pieces 84 is fed to a cutter 86. The cutter receives turns information 88 about the successive windings from a process controller (not shown) and cuts lengths 90 of tubing that are appropriate for creating the windings. The lengths 90 are delivered to a milling machine 92 which mills a helical cut in each length with a turns pitch appropriate to the desired number of turns. The resulting windings 94 pass to a final assembly station 96 where the core pieces and windings are assembled to form the finished inductors 98. An insulating station 87 is included between the milling machine and the final assembly station. Windings 94, which will have turns of relatively small width, may be treated at the insulating station to prevent shorted turns from forming after compression. A variety of insulation techniques may be used (e.g., dipping in varnish or another curable liquid coating; electrostatic coating; placement of thin insulating spacers between turns).

Figure 8:
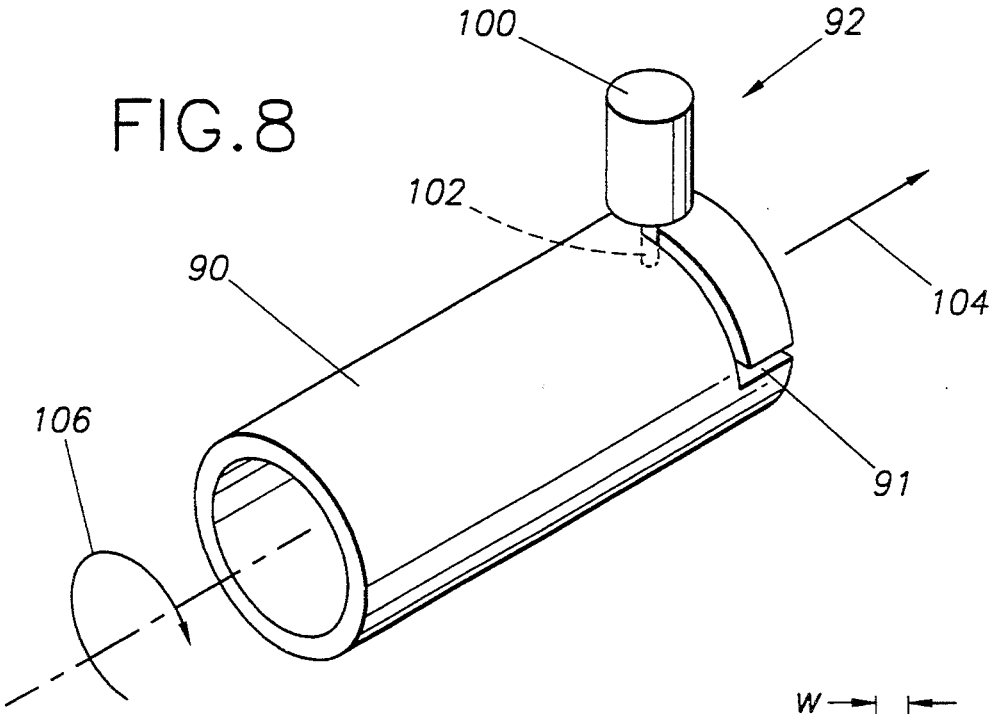
FIG. 8 shows schematically how a winding is formed by cutting a slot by means of an essentially stationary milling machine.

Referring to FIG. 8, milling machine 92 includes a milling head 100 which holds a milling tool 102. Milling head 100 is held in a generally fixed position, while tube 90 is moved axially (104) at a constant velocity, and rotated (106) at a constant angular velocity. The velocities are chosen to assure that the resulting helical cut will produce a winding which has the desired number of turns and can be compressed to fit exactly within the space provided by the core pieces. The milling machine also makes cuts 91 at the ends of the helical cuts in order to form the terminations on the winding integrally with the winding itself. If both the axial and angular velocity at which the tube is fed to the milling machine are essentially constant, then a winding having turns of uniform pitch and thickness will be cut. On the other hand, the thickness and pitch of the turns at different locations along the winding may be varied by appropriate variation of either the axial or the angular velocity, or both.

Figure 9:
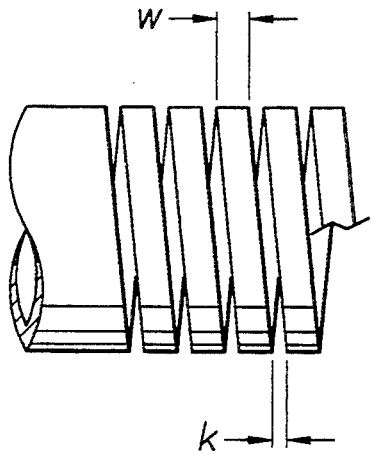
FIG. 9 is a view of a portion of a machined winding prior to compression.

Referring to FIG. 9, if the milling machine produces a kerf k, the total traverse of the compressed winding is T, and the number of turns is N, then the maximum permissible width of each turn w will be T/N (corresponding to essentially zero spacing between turns after compression) and the total length of the tube from which such a winding is to be milled will be $T+N*k+C$, where C is the total length of material needed to form the winding terminations. A winding may have as few as one turn and as many as some number determined by the minimum permissible width w.

Although the terminations in the various Figures (e.g., 38, 40, FIG. 2) are shown to extend along the axial direction of the finished winding (suitable, for example, for surface mount connection of the finished component), the terminations can also be formed into other suitable configurations after the winding is machined.

Figure 10:
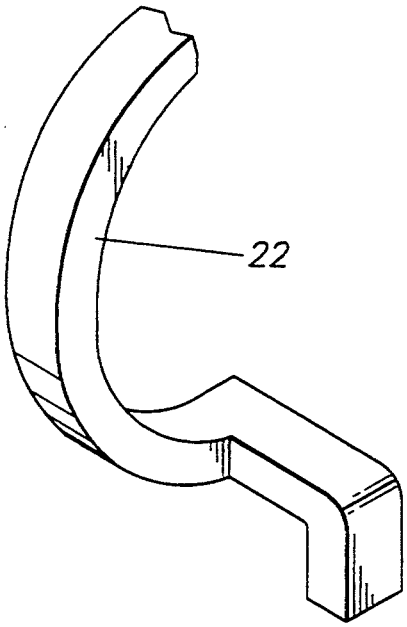
FIG. 10 is a perspective view of a termination which has been formed after machining.

For example, referring to FIG. 10, one such termination is shown as having been bent down at a right angle to the axial direction of the winding. Such a termination would be useful where the magnetic component is to be soldered into holes in a printed circuit board. A variety of other terminations may be cut and formed depending on the choice of the milling tool (e.g., 102 FIG. 8) and selection of appropriate forming equipment subsequent to milling.

Figure 11:
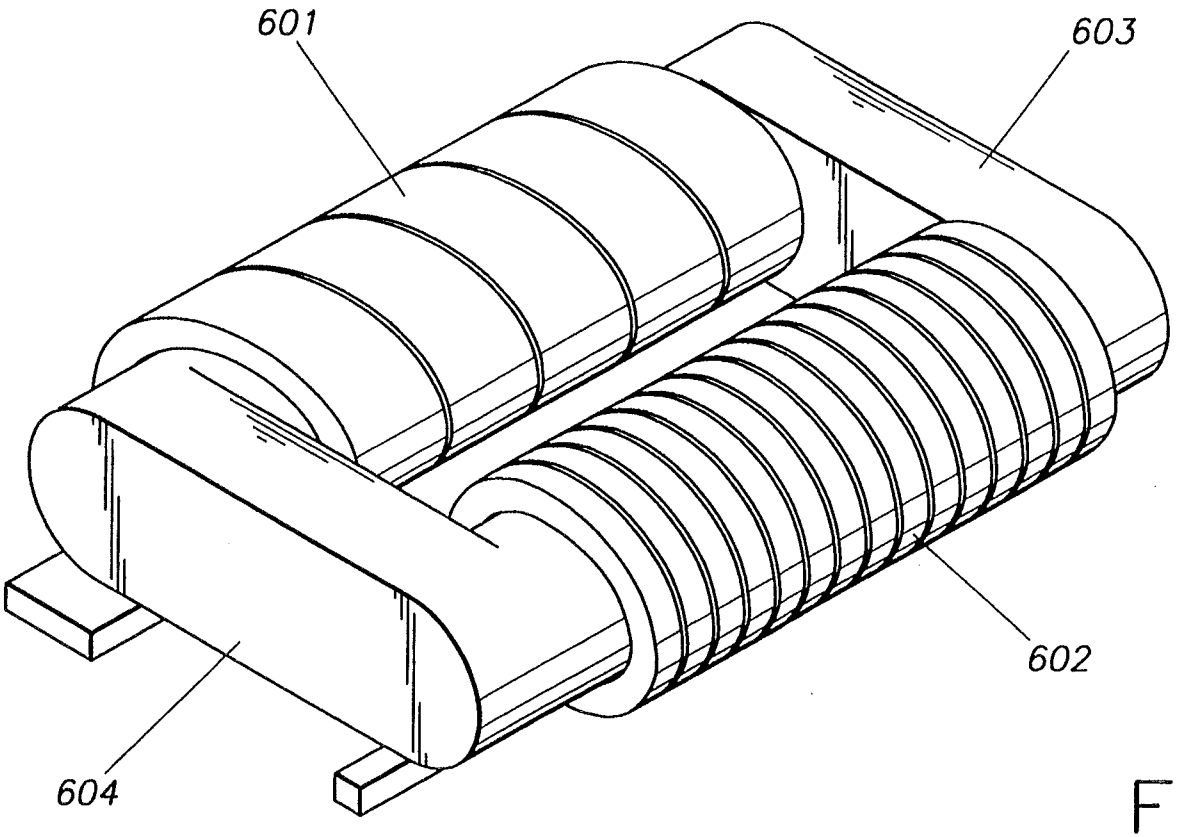
FIG. 11 is a perspective view of a transformer according to the invention.

The invention may be applied to a wide variety of magnetic structures. For example, a transformer may be constructed by utilizing two or more machined windings which are linked by a permeable magnetic path. One such transformer, shown in FIG. 11, comprises a pair of machine windings 601, 602 which are linked by a pair of symmetrically shaped core pieces 603, 604. The windings are compressed by the core pieces which contact each other in the regions inside the windings (not shown). The present invention may also be applied to magnetic components which do not include permeable cores. For example, an "air-core" inductor, for use, for example, in a radio frequency application, may be formed by use of a machined winding which is axially compressed after machining using nonpermeable materials (e.g., plastic, phenolic, etc.).

Figure 12A:
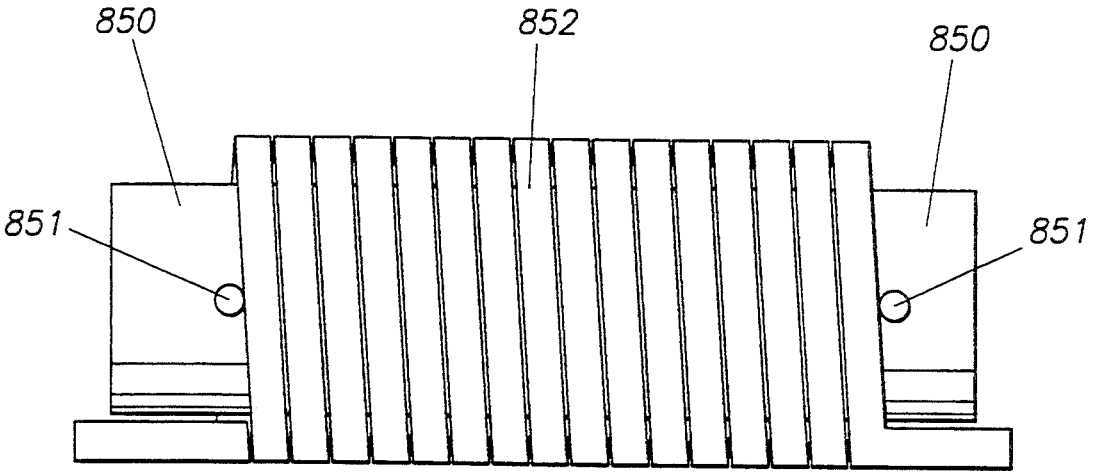
FIGS. 12A and 12B are side views of inductors according to the present invention.
Figure 12B:
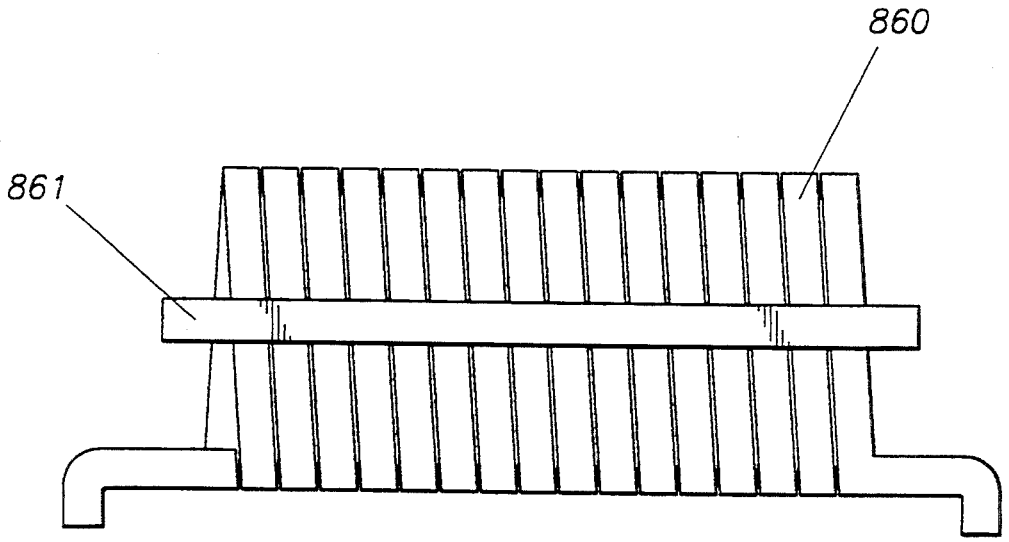

One such inductor is shown in FIG. 12A. In the Figure, the machined winding 852 is placed over a tubular, non-permeable (e.g. plastic), form 850 which maintains the turns of the winding in axial alignment. A pair of nonpermeable pins 851 hold the winding in compression. In another embodiment, shown in FIG. 12B, the machined winding 860 is held in its compressed state by a nonpermeable clip which surrounds the winding. Alternatively, the winding could be machined, compressed, and then annealed to remove tensile forces from the winding. After annealing such a winding might be used without further external supports. Thus, a magnetic component according to the present invention may comprise one or machined windings which are axially compressed after machining to reduce the space between some or all of the turns of the winding. The reduced spacing between turns can be maintained by: (a) using one or more pieces of permeable or nonpermeable material to hold at least a portion of one or more of the windings in a compressed state; or (b) by annealing after compression; or both.

The machined windings may be cut from almost any hollow conductive tube having an appropriate cross-section: round, oval, square, rectangular.

Other embodiments are within the following claims.

What is claimed is:

1. A conductive winding structure comprising a resilient helical winding having turns cut from a hollow conductive piece, said resilient winding being axially compressed after cutting so as to reduce spacing between said turns, whereby a fill factor of said resilient winding is increased.

2. An electromagnetic structure comprising a resilient helical winding having turns cut from a hollow conductive piece, and a permeable core with which said winding cooperates electromagnetically, said winding being held on said core in a compressed state such that a fill factor of said winding is increased.

3. The structure of claims 1 or 2 wherein said turns are cut from a tubular conductive piece.

4. The structure of claim 3 wherein said tubular conductive piece has a generally round cross-section.

5. The structure of claims 1 or 2 further comprising an insulating layer on said winding.

6. The structure of claim 2 wherein said core encloses a space within which a portion of said winding is housed, said portion of said winding occupying substantially the entire volume within said space.

7. The structure of claims 1 or 2 wherein there is essentially no space between the turns of said winding in its compressed state.

8. An electromagnetic structure comprising a resilient helical winding having turns cut from a hollow conductive piece, and a permeable core with which said winding cooperates electromagnetically, said winding being held on said core in a compressed state such that a fill factor of said winding is increased and further comprising winding terminations formed integrally with said winding, said winding terminations extending parallel to the longitudinal direction of said winding.

9. The structure of claim 2 wherein said core comprises a pair of core pieces which are arranged in a predetermined spatial arrangement when said winding is in said compressed state.

10. The structure of claim 9 wherein said core pieces are arranged to be in contact with each other.

11. The structure of claim 9 further comprising nonpermeable spacers, said spacers and said core pieces being arranged to be in contact with each other when said winding is in said compressed state.

12. The structure of claim 1 wherein said resilient winding is held in compression by means of one or more pieces of non-permeable material.

13. The structure of claims 1 or 2 wherein said winding is annealed after compression.

14. A conductive winding structure comprising a resilient helical winding having turns cut from a hollow conductive piece, and structure for holding said winding in an axially compressed state so as to reduce spacing between said turns.

* * * * *

UNITED STATES PATENT AND TRADEMARK OFFICE

CERTIFICATE OF CORRECTION

PATENT NO. : 5,428,337

DATED : June 27, 1995

INVENTOR(S) : Patrizio Vinciarelli et al.

It is certified that error appears in the above-identified patent and that said Letters Patent is hereby corrected as shown below:

Cover sheet of patent, item [75], delete "Vinclarelli" and insert --Vinciarelli--.

Signed and Sealed this

Tenth Day of October, 1995

*Attest:*

Bruce Lehman

BRUCE LEHMAN

*Attesting Officer*

*Commissioner of Patents and Trademarks*